US007667405B2

(12) United States Patent
Yoo et al.

(10) Patent No.: US 7,667,405 B2
(45) Date of Patent: Feb. 23, 2010

(54) PLASMA DISPLAY PANEL AND METHOD OF MANUFACTURING THEREOF

(75) Inventors: Young-Gil Yoo, Suwon-si (KR); Gun-Young Hong, Suwon-si (KR); Kyu-Hang Lee, Suwon-si (KR); Jin-Won Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 62 days.

(21) Appl. No.: 12/076,194

(22) Filed: Mar. 14, 2008

(65) Prior Publication Data

US 2008/0224613 A1 Sep. 18, 2008

(30) Foreign Application Priority Data

Mar. 15, 2007 (KR) ..... 10-2007-0025718

(51) Int. Cl.
*H01J 17/49* (2006.01)

(52) U.S. Cl. ..... 313/587; 313/586; 445/23

(58) Field of Classification Search ..... 313/582–587; 315/169.1–169.3; 445/23–25; 345/60
See application file for complete search history.

(56) References Cited

U.S. PATENT DOCUMENTS

2006/0175971 A1 8/2006 Yoo et al.

FOREIGN PATENT DOCUMENTS

KR 10 2001 0011996 A 2/2001
KR 10 2005 0019213 A 3/2005
KR 10 2005 0081078 A 8/2005

*Primary Examiner*—Joseph L Williams
*Assistant Examiner*—Brenitra M Lee
(74) *Attorney, Agent, or Firm*—Lee & Morse, P.C.

(57) ABSTRACT

A PDP includes first and second substrates, a plurality of electrodes between the first and second substrates, a plurality of barrier ribs between the first and second substrates to define discharge cells, at least one dielectric layer on the electrodes, at least one photoluminescent layer in each discharge cell, a discharge gas in the discharge cells, and a protective layer on the dielectric layer, the protective layer including magnesium oxide and a light-scattering material having a general formula $MO_x$, where M includes one or more of zinc and/or titanium and $1 \leqq x \leqq 2$, the light-scattering material having a particle size of about 100 nm to about 900 nm and being present in the protective layer in an amount of about 1% to about 20% by weight of a total weight of the dielectric layer.

15 Claims, 4 Drawing Sheets

PLASMA DISPLAY PANEL AND METHOD OF MANUFACTURING THEREOF

BACKGROUND OF THE INVENTION

1. Field of the Invention

Embodiments of the present invention relate to a plasma display panel (PDP) and a method of manufacturing thereof. More particularly, embodiments of the present invention relate to a PDP having reduced external light reflection and improved blue brightness efficiency.

2. Description of the Related Art

A PDP refers to a display device using a plasma phenomenon, i.e., a gas-discharge phenomenon, to display images. For example, application of a predetermined voltage to electrodes between two substrates may cause excitation of a discharge gas between the electrodes to trigger emission of light from photoluminescent layers. PDPs may be broadly classified as direct current (DC) type PDPs, i.e., where current flows through electrodes exposed to plasma, and as alternating current (AC) type PDPs, i.e., where current flows through electrodes coated with dielectric materials.

Conventional PDPs, e.g., a reflective AC-driven PDP, may include the electrodes between the two substrates, barrier ribs between the two substrates to define discharge cells, photoluminescent layers in the discharge cells, at least one dielectric layer to coat the electrodes, and a protective layer on the dielectric layer. The conventional photoluminescent layers may include red, green, and blue photoluminescent layers that emit red, green, and blue lights, respectively.

The conventional PDP may realize a relatively sensitive screen when it satisfies a color temperature of about 8000 K or higher. In the conventional PDP, however, blue photoluminescent layers may exhibit lower brightness efficiency and bright room contrast ratio than red and/or green photoluminescent layers. Additionally, the conventional electrodes and barrier ribs of the PDP may be formed of white materials, so an external light reflection rate may be high, thereby reducing bright room contrast ratio further.

Attempts have been made to improve the bright room contrast of the PDP. For example, an inorganic pigment has been added to a transparent dielectric layer of an upper substrate to reduce light reflection. A dielectric layer with a pigment, i.e., a colored dielectric layer, however, may reduce display characteristic of the PDP due to reduced light transmittance therethrough.

SUMMARY OF THE INVENTION

Embodiments of the present invention are therefore directed to a PDP, which substantially overcomes one or more of the disadvantages and shortcomings of the related art.

It is therefore a feature of an embodiment of the present invention to provide a PDP with a protective layer including a light-scattering material therein.

It is therefore a feature of an embodiment of the present invention to provide a method of manufacturing a PDP with a protective layer including a light-scattering material therein.

At least one of the above and other features and advantages of the present invention may be realized by providing a PDP, including a first substrate spaced apart from a second substrate by a predetermined distance, a plurality of display electrodes along a first direction between the first and second substrates, a plurality of address electrodes along a second direction between the first and second substrates, the second direction crossing the first direction, a plurality of barrier ribs between the first and second substrates to define discharge cells, at least one dielectric layer between the display and address electrodes, at least one photoluminescent layer in each discharge cell, a discharge gas in the discharge cells, and a protective layer on the dielectric layer, the protective layer including magnesium oxide and a light-scattering material having a general formula $MO_x$, where M includes one or more of zinc and/or titanium and $1 \leqq x \leqq 2$, the light-scattering material having a particle size of about 100 nm to about 900 nm and being present in the protective layer in an amount of about 1% to about 20% by weight of a total weight of the dielectric layer. The light-scattering material may include one or more of zinc oxide and/or titanium oxide. The light-scattering material may be zinc oxide. The light-scattering material may have a particle size of about 300 nm to about 700 nm.

The protective layer may include a uniform mixture of the light-scattering material and the magnesium oxide. The mixture of the light-scattering material and the magnesium oxide may be on an entire surface of the dielectric layer. The mixture of the light-scattering material and the magnesium oxide may be only on predetermined portions of the dielectric layer. The predetermined portions of the dielectric layer may overlap discharge cells with blue photoluminescent layers. The protective layer may include first portions and second portions, only the first portions including the light-scattering material. The first portions of the protective layer may extend only along discharge cells with blue photoluminescent layers. The first portions may entirely overlap with the blue photoluminescent layers.

A relation of $T_{ALL}$:$T_{BLUE}$ may be about 1:1.05 to about 1:1.30, $T_{ALL}$ being a transmittance value of light transmitted through the protective layer toward a screen of the PDP and having a wavelength of about 410 nm to about 700 nm, and $T_{BLUE}$ being a transmittance value of light transmitted through the protective layer toward a screen of the PDP and having a wavelength of about 410 nm to about 470 nm. The discharge gas may include xenon, helium, and neon, a partial pressure of the xenon being about 10% to about 15% of a total pressure of the discharge gas, a partial pressure of the helium being about 10% to about 60% of the total pressure of the discharge gas, and a partial pressure of the neon being about 25% to about 80% of the total pressure of the discharge gas.

At least one of the above and other features and advantages of the present invention may be also realized by providing a method of forming a PDP, including forming a plurality of display electrodes along a first direction between first and second substrates, forming a plurality of address electrodes along a second direction between the first and second substrates, the second direction crossing the first direction, forming a plurality of barrier ribs between the first and second substrates to define discharge cells, forming at least one dielectric layer between the display and address electrodes, forming at least one photoluminescent layer in each discharge cell, filling a discharge gas in the discharge cells, and forming a protective layer on the dielectric layer, the protective layer including magnesium oxide and a light-scattering material having a general formula $MO_x$, where M includes one or more of zinc and/or titanium and $1 \leqq x \leqq 2$, the light-scattering material having a particle size of about 100 nm to about 900 nm and being present in the protective layer in an amount of about 1% to about 20% by weight of a total weight of the dielectric layer. Forming the protective layer may include one or more of a beam deposition, an ion plating, a magnetron sputtering, a thick-layer printing method, a dip coating, a die coating, a spin coating, a green sheet coating, and/or an ink-jet coating.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
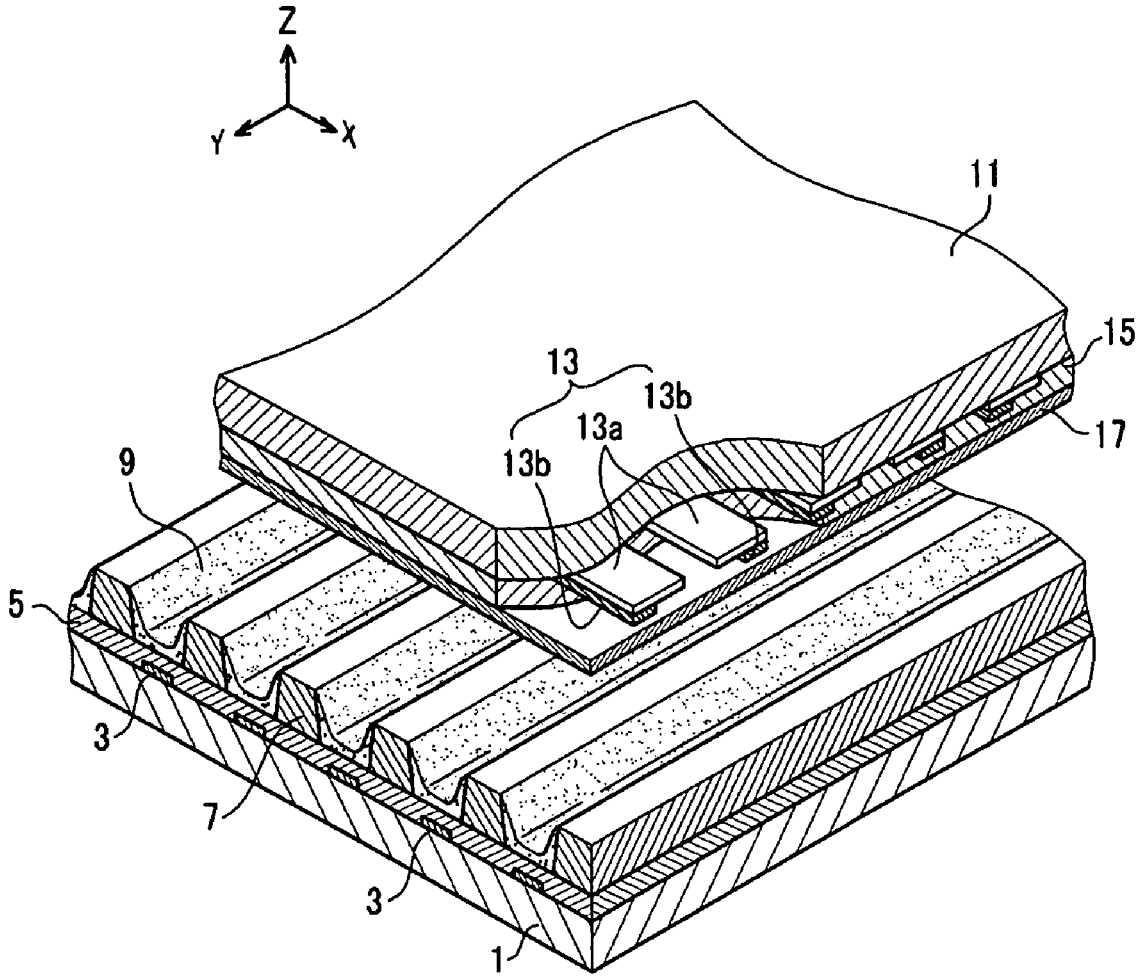
FIG. 1 illustrates a partial exploded perspective view of a PDP according to an embodiment of the present invention.

Korean Patent Application No. 10-2007-0025718, filed on Mar. 15, 2007, in the Korean Intellectual Property Office, and entitled: "Plasma Display Panel," is incorporated by reference herein in its entirety.

Embodiments of the present invention will now be described more fully hereinafter with reference to the accompanying drawings, in which exemplary embodiments of the invention are illustrated. Aspects of the invention may, however, be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of layers, elements, and regions may be exaggerated for clarity of illustration. It will also be understood that when a layer or element is referred to as being "on" another layer, element, or substrate, it can be directly on the other layer, element, or substrate, or intervening layers and/or elements may also be present. Further, it will also be understood that when a layer or element is referred to as being "between" two layers or elements, it can be the only layer or element between the two layers or elements, or one or more intervening layers and/or elements may also be present. Like reference numerals refer to like elements throughout.

As used herein, the expressions "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" includes the following meanings: A alone; B alone; C alone; both A and B together; both A and C together; both B and C together; and all three of A, B, and C together. Further, these expressions are open-ended, unless expressly designated to the contrary by their combination with the term "consisting of." For example, the expression "at least one of A, B, and C" may also include an nth member, where n is greater than 3, whereas the expression "at least one selected from the group consisting of A, B, and C" does not.

As used herein, the terms "a" and "an" are open terms that may be used in conjunction with singular items or with plural items. For example, the term "a light scattering material" may represent a single compound, e.g., zinc oxide, or multiple compounds in combination, e.g., zinc oxide mixed with titanium oxide.

According to an embodiment of the present invention, a protective layer of a PDP may include magnesium oxide (MgO) and a light-scattering material. Use of the scattering light material in the protective layer according to embodiments of the present invention may be advantageous in both reducing external light reflection by coloring the protective layer in blue and improving brightness efficiency of a blue photoluminescent layer.

The light-scattering material of the protective layer may be any suitable oxide material capable of coloring the protective layer in blue. For example, the light-scattering material may be a metal oxide represented by a general formula $MO_x$, where M may be one or more of zinc (Zn) and/or titanium (Ti), and $1 \leqq x \leqq 2$. Examples of the light-scattering material may include one or more of zinc oxide (ZnO) and/or titanium oxide ($TiO_2$).

The light-scattering material may be present in the protective layer in an amount of about 1% to about 20% by weight, based on a total weight of the protective layer. For example, the light-scattering material may be present in the protective layer in an amount of about 5% to about 15% by weight. When the amount of the light-scattering material in the protective layer is lower than about 1% by weight, the amount of the light-scattering material may be too low to impart sufficient blue color to the protective layer, e.g., increase of blue brightness may not be attained. When the amount of the light-scattering material in the protective layer is higher than about 20% by weight, the light-scattering material may affect properties of the protective layer, e.g., reduce emission of secondary electrons.

The light-scattering material may have a particle size, i.e., an average diameter, of about 100 nm to about 900 nm. For example, the light-scattering material may have a particle size of about 300 nm to about 700 nm. In another example, particles of the light-scattering material may include diameters of one or more of about 150 nm, about 200 nm, about 250 nm, about 350 nm, about 400 nm, about 450 nm, about 500 nm, about 550 nm, about 600 nm, about 650 nm, about 700 nm, about 750 nm, about 800 nm, and/or about 850 nm. When the particle size is smaller than about 100 nm, the particles may coagulate with each other, thereby reducing mixing uniformity within the protective layer. When the particle size is greater than about 900 nm, the particles may modify properties of the protective layer.

Use of the light-scattering material to impart a blue color to the protective layer may improve transmittance of blue light through the protective layer. As such blue light efficiency may be enhanced. Accordingly, a relation of all the visible light transmitted through the protective layer toward a screen of the PDP relatively to the blue light transmitted therethrough, i.e., the relation $T_{ALL}$:$T_{BLUE}$, may have a ratio of about 1:1.05 to about 1:1.30. It is noted that $T_{ALL}$ refers to a transmittance value of light having a wavelength ranging from about 410 nm to about 700 nm, and $T_{BLUE}$ refers to a transmittance value of light having a wavelength ranging from about 410 nm to about 470 nm. It is further noted, as indicated by the ratio of the relation $T_{ALL}$:$T_{BLUE}$, that light transmittance through the substrate may increase as an amount of the light-scattering material in the protective layer increases, i.e., blue color is enhanced. When the transmittance value is lower than about 1:1.05, an increase of transmittance of blue light may be too low. When the transmittance value is higher than about 1:1.30, transmittance of the blue light may be too high, so the PDP display efficiency may be deteriorated.

An exemplary embodiment of a PDP including the protective layer described previously is illustrated in FIG. 1. Referring to FIG. 1, the PDP may include a first substrate 1, e.g., a rear substrate, a second substrate 11, e.g., a front substrate including a screen, parallel to the first substrate 1, address electrodes 3, barrier ribs 7, display electrodes 13, and a protective layer 17. The protective layer 17 may be the protective layer described previously.

The address electrodes 3 may be parallel to each other, and may be disposed along a first direction, e.g., along the y-axis, on the first substrate 1. A first dielectric layer 5 may be disposed to cover the address electrodes 3, such that the address electrodes 3 may be between the first substrate 1 and the first dielectric layer 5. The barrier ribs 7 may be formed to a predetermined height on the first dielectric layer 5 to define discharge cells of any suitable shape. For example, as illustrated in FIG. 1, each discharge cell may extend along the first direction between two barrier ribs 7, and may correspond to one address electrode 3. Photoluminescent layers 9, e.g., red (R), green (G), and blue (B) phosphor layers, may be disposed in the discharge cells, e.g., on surfaces of the barrier ribs 7.

The display electrodes 13, i.e., pairs of transparent and bus electrodes 13*a* and 13*b*, may extend along a second direction, e.g., along the x-axis, on the second substrate 11. The display electrodes 13 may face the first substrate 1, and may cross the address electrodes 3. A second dielectric layer 15, e.g., formed by a printing process, may be disposed on the second substrate 11 to face the first substrate 1, such that the display electrodes 13 may be between the second substrate 11 and the second dielectric layer 15. The second dielectric layer 15 may be substantially similar to the first dielectric layer 5. The protective layer 17 may be on the second dielectric layer 15 to face the first substrate 1.

The protective layer 17 may be thinner than the second dielectric layer 15, e.g., the protective layer 17 may have a thickness in an order of hundreds of nanometers, so sputtering of ions and electrons during discharge may be reduced. Reduced sputtering of ions may prevent or substantially minimize discharge damage to the second dielectric layer 15 and/or display electrodes 13, so lifespan of the PDP may be increased. The protective layer 17 may reduce discharge voltage. The protective layer 17 may be the protective layer described previously, and therefore, may also reduce external light reflection and improve blue brightness efficiency. In particular, the protective layer 17 may include magnesium oxide and a light-scattering material, e.g., an oxide having a general formula $MO_x$, where M may be one or more of Zn and/or Ti, and $1 \leqq x \leqq 2$. The light-scattering material may be mixed with the magnesium oxide to form a uniform mixture, i.e., even distribution of the light-scattering material within the magnesium oxide. The uniform mixture may be used to form the protective layer 17, so the uniform mixture may be on an entire surface of the second dielectric layer 15. Alternatively, the uniform mixture may be used to form portions of the protective layer 17, so the uniform mixture may be selectively only on predetermined portions of the dielectric layer 15. For example, the uniform mixture may be on portions of the dielectric layer 15 that correspond, i.e., overlap, to the B phosphor of the photoluminescent layers 9. Use of the light-scattering material in the protective layer 17 may impart blue color thereto, so reflection of external light may be prevented or substantially minimized, and blue light brightness and efficiency may be improved.

Figure 2:
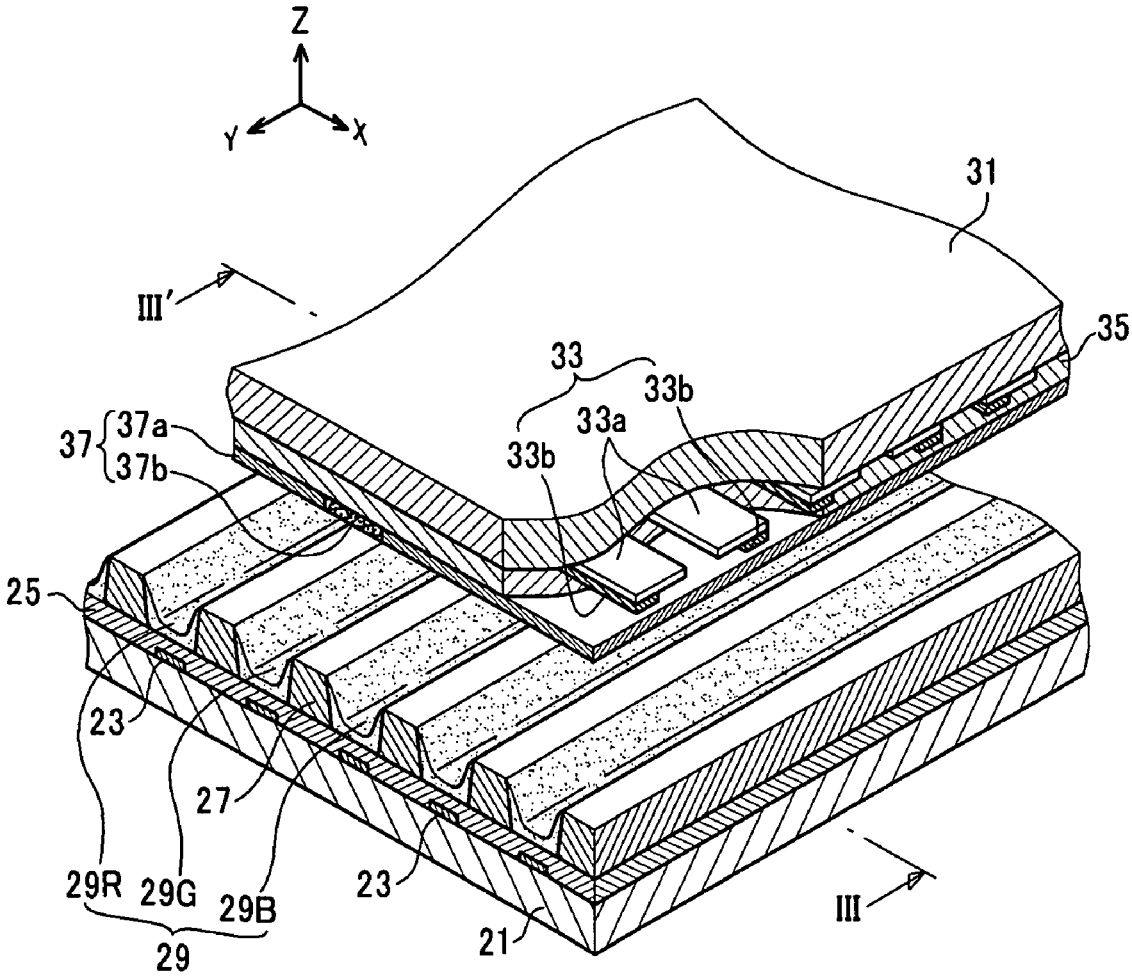
FIG. 2 illustrates a partial exploded perspective view of a PDP according to another embodiment of the present invention.
Figure 3:
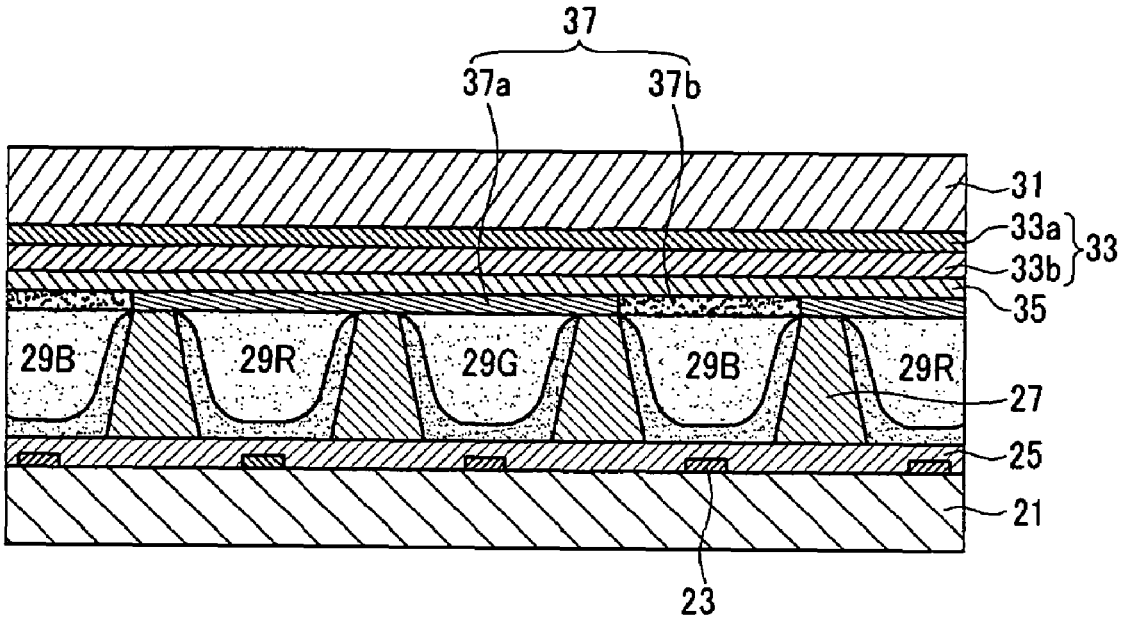
FIG. 3 illustrates a cross-sectional view of the PDP of FIG. 2.

FIG. 2 illustrates a partial exploded perspective view of a PDP according to another embodiment of the present invention and FIG. 3 illustrates a cross-sectional view of the PDP of FIG. 2. Referring to FIGS. 2 and 3, the PDP may include a first substrate 21 spaced apart from a second substrate 31 by a predetermined distance; a plurality of display electrodes 33 along a first direction between the first and second substrates 21 and 31; a plurality of address electrodes 23 along a second direction between the first and second substrates 21 and 31, the second direction crossing the first direction; a plurality of barrier ribs 27 between the first and second substrates 21 and 31 to define discharge cells; at least one dielectric layer 25 between the display and address electrodes; at least one photoluminescent layer 29 in each discharge cell; a discharge gas in the discharge cells; and a protective layer 37 on the second dielectric layer 35. The display electrodes 33 include pairs of transparent and bus electrodes 33*a* and 33*b*. The protective layer 37 may include portions 37*a* including only the magnesium oxide and portions 37*b* including a uniform mixture of magnesium oxide and a light-scattering material. The portions 37*b* including the uniform mixture correspond to the B phosphor of photoluminescent layers 29B.

The protective layer 17 or 37 may be formed by a dry method or by a wet method. The dry method may include electron beam deposition, ion plating, and/or magnetron sputtering. For example, a metal, e.g., M of the $MO_x$ in a powder form, may be added to magnesium to form a target or a tablet, followed by deposition in an oxygen atmosphere to facilitate metal oxidation. The wet method may include thick-layer printing, dip coating, dye coating, spin coating, green sheet coating, and/or ink-jet coating. For example, a light-scattering material, e.g., $MO_x$, may be uniformly mixed with magnesium oxide powder, followed by coating a desired surface, e.g., a surface of the second dielectric layer 15 or 35, with the resultant mixture. The coated second dielectric layer 15 or 35 may be baked to finalize the protective layer 17 or 37 thereon.

The discharge cells of the PDP may include a discharge gas therein. The discharge gas may include, e.g., one or more of xenon (Xe), helium (He), and/or neon (Ne). A predetermined mixing ratio of the discharge gas may affect color of the discharge gas and the discharge brightness, so the mixing ratio of the discharge gas may affect electrical/optical parameters of the PDP, e.g., color purity of light emitted from the B phosphor layers. For example, a colorless discharge gas with low discharge brightness may not affect color realization of the photoluminescent layers 9 or 29, so color purity of light emitted from the photoluminescent layers 9 may be improved. More specifically, for example, the predetermined mixing ratio of the discharge gas may include Xe at a partial pressure of about 10% to about 15% of the total discharge gas, He at a partial pressure of about 10% to about 60% of the total discharge gas, and Ne at a partial pressure of about 25% to about 80% of the total discharge gas.

Use of the discharge gas at the predetermined mixing ratio may decrease discharge delay time during the PDP operation, and may improve brightness thereof. When partial pressures of the discharge gas are not within the specified ranges, discharge delay time may be increased and brightness may be reduced. It is noted that discharge brightness of the PDP may be determined based on properties of the ultraviolet (UV) light generated by the discharge gas. For example, longer wavelengths of the UV light may increase discharge brightness.

A PDP according to embodiments of the present invention may include a protective layer having a light-scattering material imparting a blue color thereto, so external light reflection may be reduced and blue brightness efficiency may be improved to realize a high quality screen. The PDP may further include a discharge gas mixture at a predetermined mixing ratio to improve color purity of light emitted therefrom.

EXAMPLES

Example 1 silver bus electrodes were formed on transparent electrodes, i.e., indium tin oxide (ITO) electrodes, to form display electrodes. The display electrodes were attached to a front substrate formed of soda lime glass. The display electrodes were arranged in a stripe form, the transparent electrodes being between the bus electrodes and the substrate. Subsequently, a dielectric layer of lead glass paste was coated on an entire surface of the front substrate, followed by baking. The dielectric layer was applied so the display electrodes were between the front substrate and the dielectric layer.

$TiO_2$ powder having an average particle size of 700 nm was mixed with MgO at a weight ratio of 20:80 to form a protective layer composition. The protective layer composition was coated on an entire surface of the dielectric layer by a thick-layer printing method to form a protective layer and to finalize an upper panel of the PDP. A lower panel was prepared and attached to the upper panel. The upper and lower panels were assembled and sealed together, and then an interior of the PDP was exhausted to remove, e.g., impurities. A discharge gas mixture was prepared to have a pressure of 200 Torr, i.e., partial pressure of Xe being 15% of the total pressure, partial pressure of He being 35% of the total pressure, and partial pressure of Ne being 50% of the total pressure. Next, the PDP was aged.

Example 2 a PDP was manufactured according to the same method as Example 1, with the exception of using MgO and $TiO_2$ at a weight ratio of 90:10 in the protective layer.

Example 3 a PDP was manufactured according to the same method as in Example 1, with the exception of using MgO and $TiO_2$ at a weight ratio of 95:5 in the protective layer.

Example 4 a PDP was manufactured according to the same method as in Example 1, with the exception of using MgO and $TiO_2$ at a weight ratio of 99:1 in the protective layer.

Example 5 a PDP was manufactured according to the same method as in Example 2, with the exception of using $TiO_2$ having an average particle size of 100 nm.

Example 6 a PDP was manufactured according to the same method as in Example 3, with the exception of using $TiO_2$ having an average particle size of 300 nm.

Example 7 a PDP was manufactured according to the same method as in Example 4, with the exception of using $TiO_2$ having an average particle size of 900 nm.

Example 8 a PDP was manufactured according to the same method as in Example 1, with the exception of using ZnO having a particle size of 900 nm, instead of using $TiO_2$ having an average particle size of 700 nm.

Comparative Example 1 a PDP was manufactured according to the same method as in Example 1, with the exception that no $TiO_2$ was used.

The PDPs of Examples 1-8 and Comparative Example 1 were evaluated in terms of transmittance of light, i.e., light generated in the PDP, through the PDP using a spectrophotometer (CM-2600d, Otsuka Electronic Co. Ltd.).

Figure 4:
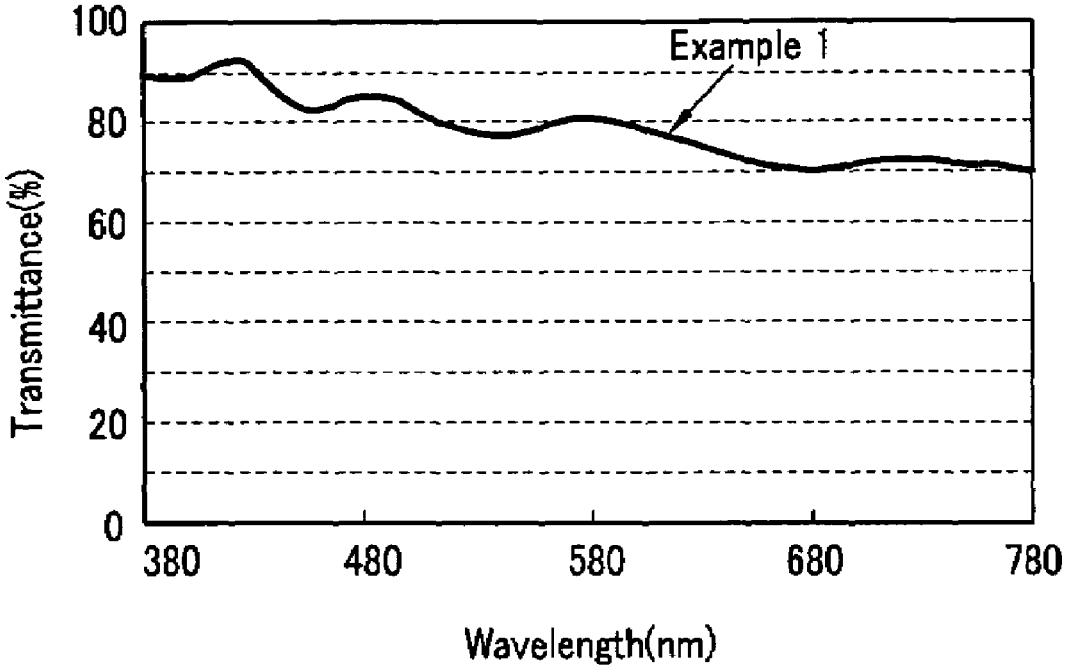
FIG. 4 illustrates a graph of light transmittance through an upper panel of a PDP according to Example 1.

FIG. 4 illustrates light transmittance through the PDP of Example 1. Referring to FIG. 4, a PDP having a protective layer formed according to Example 1 exhibited transmittance of over 80% in the blue light region, i.e., a wavelength of about 410 nm to about 470 nm. This result indicates that coloring of the protective layer in blue increases transmittance of blue light in the PDP, so blue brightness efficiency is substantially improved.

Embodiments of a PDP according to the present invention may realize a high quality display due to a decrease of external light reflection and improvement of brightness efficiency of a blue phosphor layer by including a light-scattering material in a protective layer. Accordingly, overall brightness efficiency and bright room contrast may be improved.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel (PDP), comprising:

a first substrate spaced apart from a second substrate by a predetermined distance;

a plurality of display electrodes along a first direction between the first and second substrates;

a plurality of address electrodes along a second direction between the first and second substrates, the second direction crossing the first direction;

a plurality of barrier ribs between the first and second substrates to define discharge cells;

at least one dielectric layer between the display and address electrodes;

at least one photoluminescent layer in each discharge cell;

a discharge gas in the discharge cells; and a protective layer on the dielectric layer, the protective layer including magnesium oxide and a light-scattering material having a general formula $MO_x$, where M includes one or more of zinc and/or titanium and $1 \leqq x \leqq 2$, the light-scattering material having a particle size of about 100 nm to about 900 nm and being present in the protective layer in an amount of about 1% to about 20% by weight of a total weight of the dielectric layer.

2. The PDP as claimed in claim 1, wherein the light-scattering material includes one or more of zinc oxide and/or titanium oxide.

3. The PDP as claimed in claim 2, wherein the light-scattering material is zinc oxide.

4. The PDP as claimed in claim 2, wherein the light-scattering material has a particle size of about 300 nm to about 700 nm.

5. The PDP as claimed in claim 1, wherein the protective layer includes a uniform mixture of the light-scattering material and the magnesium oxide.

6. The PDP as claimed in claim 5, wherein the mixture of the light-scattering material and the magnesium oxide is on an entire surface of the dielectric layer.

7. The PDP as claimed in claim 5, wherein the mixture of the light-scattering material and the magnesium oxide is only on predetermined portions of the dielectric layer.

8. The PDP as claimed in claim 7, wherein the predetermined portions of the dielectric layer overlap discharge cells with blue photoluminescent layers.

9. The PDP as claimed in claim 1, wherein the protective layer includes first portions and second portions, only the first portions including the light-scattering material.

10. The PDP as claimed in claim 9, wherein the first portions of the protective layer extend only over discharge cells with blue photoluminescent layers.

11. The PDP as claimed in claim 10, wherein the first portions entirely overlap the blue photoluminescent layers.

12. The PDP as claimed in claim 1, wherein a relation of $T_{ALL}$:$T_{BLUE}$ is about 1:1.05 to about 1:1.30, $T_{ALL}$ being a transmittance value of light transmitted through the protective layer toward a screen of the PDP and having a wavelength of about 410 nm to about 700 nm, and $T_{BLUE}$ being a transmittance value of light transmitted through the protective layer toward a screen of the PDP and having a wavelength of about 410 nm to about 470 nm.

13. The PDP as claimed in claim 1, wherein the discharge gas includes xenon, helium, and neon, a partial pressure of the xenon gas being about 10% to about 15% of a total pressure of the discharge gas, a partial pressure of the helium gas being about 10% to about 60% of the total pressure of the discharge gas, and a partial pressure of the neon gas being about 25% to about 80% of the total pressure of the discharge gas.

14. A method of manufacturing a plasma display panel (PDP), comprising:

forming a plurality of display electrodes along a first direction between first and second substrates;

forming a plurality of address electrodes along a second direction between the first and second substrates, the second direction crossing the first direction;

forming a plurality of barrier ribs between the first and second substrates to define discharge cells;

forming at least one dielectric layer between the display and address electrodes;

forming at least one photoluminescent layer in each discharge cell;

filling a discharge gas in the discharge cells; and forming a protective layer on the dielectric layer, the protective layer including magnesium oxide and a light-scattering material having a general formula $MO_x$, where M includes one or more of zinc and/or titanium and $1 \leqq x \leqq 2$, the light-scattering material having a particle size of about 100 nm to about 900 nm and being present in the protective layer in an amount of about 1% to about 20% by weight of a total weight of the dielectric layer.

15. The method as claimed in claim 14, wherein forming the protective layer includes one or more of a beam deposition, an ion plating, a magnetron sputtering, a thick-layer printing method, a dip coating, a die coating, a spin coating, a green sheet coating, and/or an ink-jet coating.

* * * * *